US006190205B1

(12) United States Patent
Wu

(10) Patent No.: US 6,190,205 B1
(45) Date of Patent: Feb. 20, 2001

(54) ELECTRICAL JACK

(75) Inventor: Kun-Tsan Wu, Tu-Chen (TW)

(73) Assignee: Hon Hai Precision Ind. Co., Ltd., Taiepi Hsen (TW)

( * ) Notice: Under 35 U.S.C. 154(b), the term of this patent shall be extended for 0 days.

(21) Appl. No.: 09/337,977

(22) Filed: Jun. 22, 1999

(30) Foreign Application Priority Data

Dec. 22, 1998 (TW) ..... 87221339

(51) Int. Cl.[7] ..... H01R 13/648
(52) U.S. Cl. ..... 439/607; 439/939
(58) Field of Search ..... 439/607, 609, 439/668, 669, 939

(56) References Cited

U.S. PATENT DOCUMENTS 5,338,215 * 8/1994 Lee et al. ..... 439/607
5,919,052 * 7/1999 Ho ..... 439/668
6,050,854 * 4/2000 Fang et al. ..... 439/607

* cited by examiner

*Primary Examiner*—Neil Abrams
*Assistant Examiner*—Javaid Nasri
(74) *Attorney, Agent, or Firm*—Wei Te Chung

(57) ABSTRACT

An electrical jack includes an insulative housing containing contact elements therein for engaging with a mating plug. A shielding casing encloses the insulative housing. A grounding member is received in a slot defined in the insulative housing and extends beyond the housing for being electrically grounded. The shielding casing has an extension received in the slot for physically contacting the grounding member thereby grounding the shielding casing. The shielding casing has a resilient flap for being engaged by a grounding member of the mating plug thereby further grounding the shielding casing. The resilient flap is deformed by the mating plug for ensuring proper contact therebetween.

1 Claim, 6 Drawing Sheets

ELECTRICAL JACK

BACKGROUND OF THE INVENTION

1. Field of the Invention

The present invention generally relates to an electrical jack, and in particular to an electrical jack having excellent electrical shielding properties.

2. The Prior Art

An electrical jack mounted on a circuit board for receiving a plug to transmit electrical signals is well known in the electronics field. Examples are disclosed in U.S. Pat. No. 5,092,795 and Japanese Patent No. 61-74977. FIGS. 1 and 2 of the attached drawings respectively show conventional electrical jacks disclosed in the references. An electrical shielding casing encloses the electrical jack for suppressing electromagnetic interference. The conventional jacks, however, do not have good electrical shielding properties. Thus, it is desired to have an electrical jack having excellent electrical shielding properties.

SUMMARY OF THE INVENTION

Accordingly, an object, of the present invention is to provide an electrical jack having excellent electrical shielding properties.

Another object of the present invention is to provide an electrical jack having a double-grounded shielding casing.

A further object of the present invention is to provide an electrical jack having an easily manufactured shielding casing.

To achieve the above objects, an electrical jack in accordance with the present invention comprises an insulative housing containing contact elements therein for engaging with a mating plug. A shielding casing encloses the insulative housing. A grounding member is received in a slot defined in the insulative housing and extends beyond the housing for being electrically grounded. The shielding casing has an extension received in the slot for physically contacting the grounding member thereby grounding the shielding casing. The shielding casing has a resilient flap for being engaged by a grounding member of the mating plug thereby further grounding the shielding casing. The resilient flap is deformed by the mating plug for ensuring proper contact therebetween.

BRIEF DESCRIPTION OF THE DRAWINGS

The present invention will be apparent to those skilled in the art by reading the following description of preferred embodiments thereof, with reference to the accompanying drawings, in which.

DETAILED DESCRIPTION OF THE PREFERRED EMBODIMENT

Figure 1:
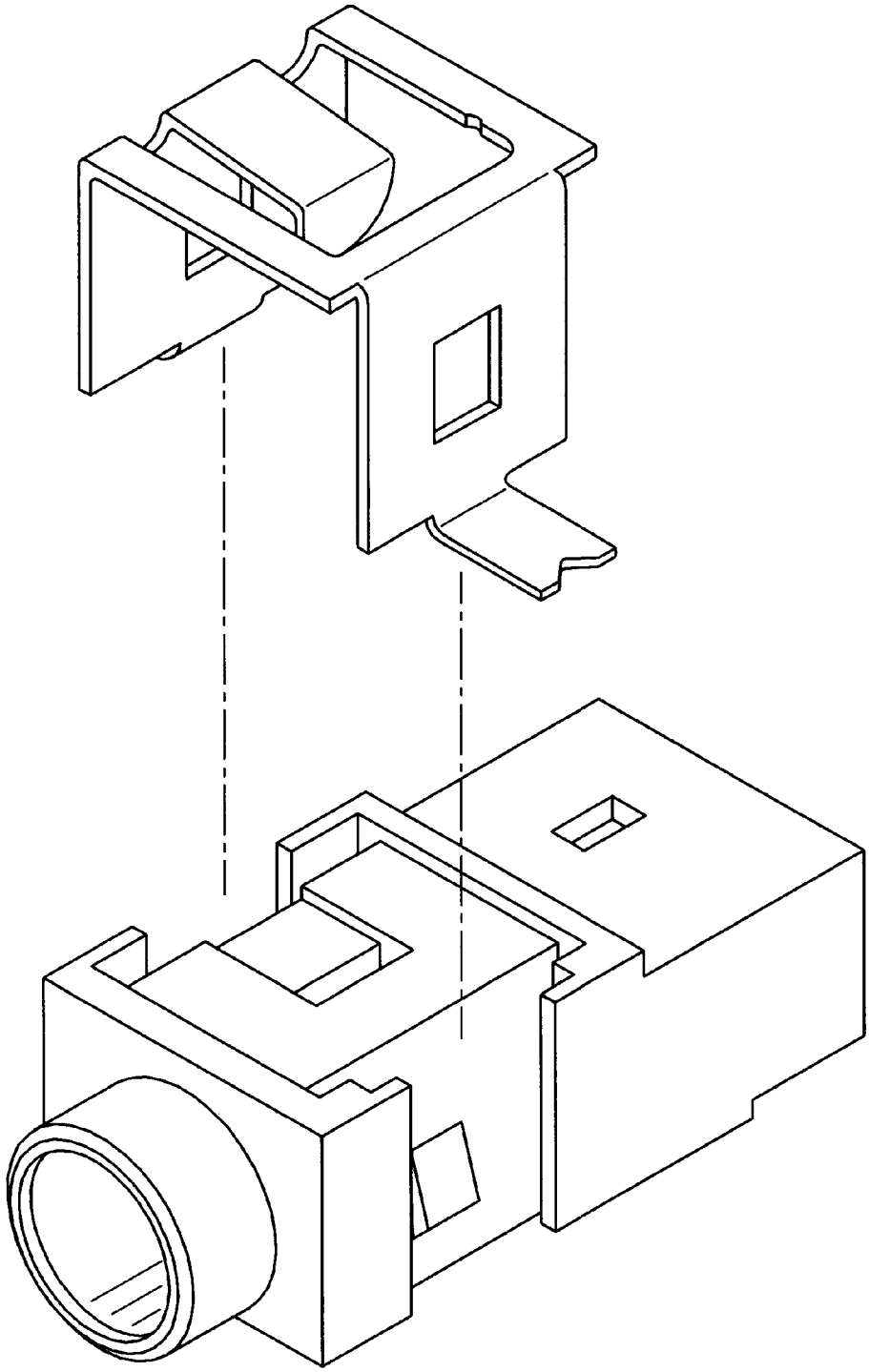
FIG.1 PRIOR ART
FIG. 1 is an exploded view of a conventional electrical jack disclosed in U.S. Pat. No. 5,092,795.
Figure 2:
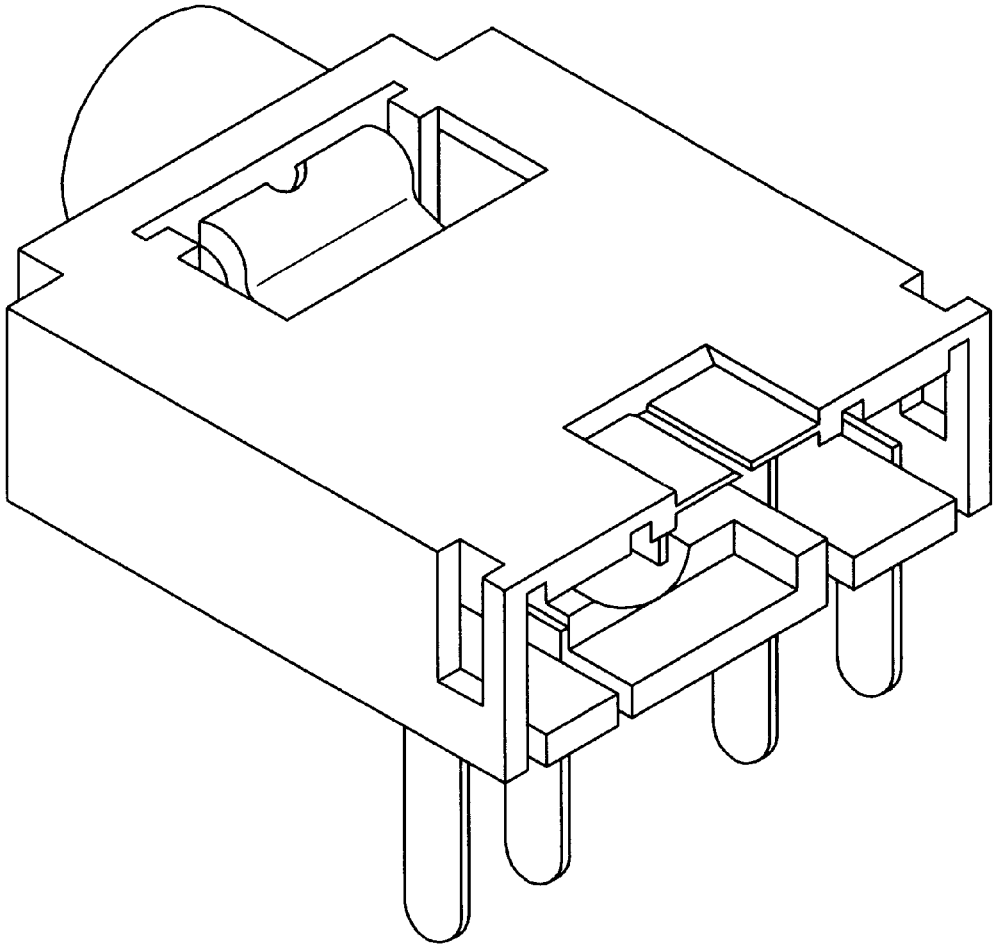
FIG.2 PRIOR ART
FIG. 2 is a perspective view of a conventional electrical jack disclosed in Japanese Patent No. 61-74977.
Figure 3:
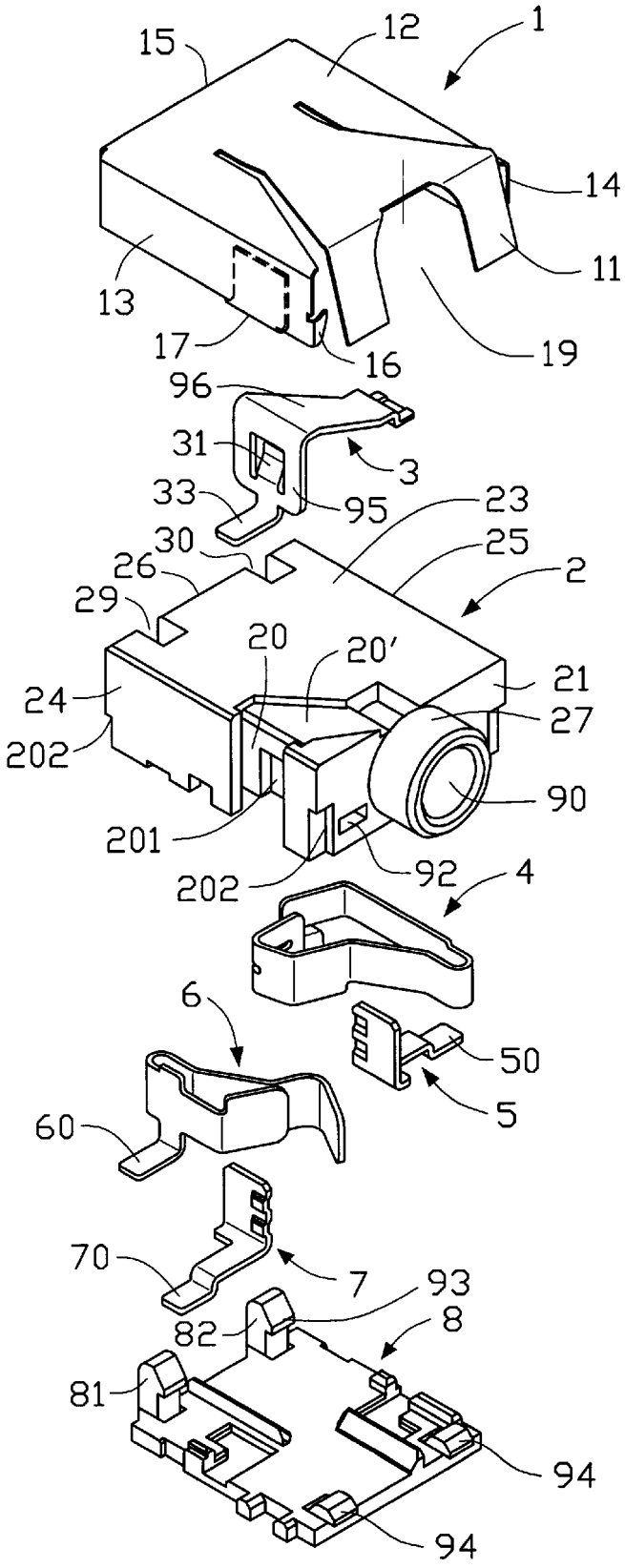
FIG. 3 is an exploded view of an electrical jack constructed in accordance with the present invention.
Figure 4:
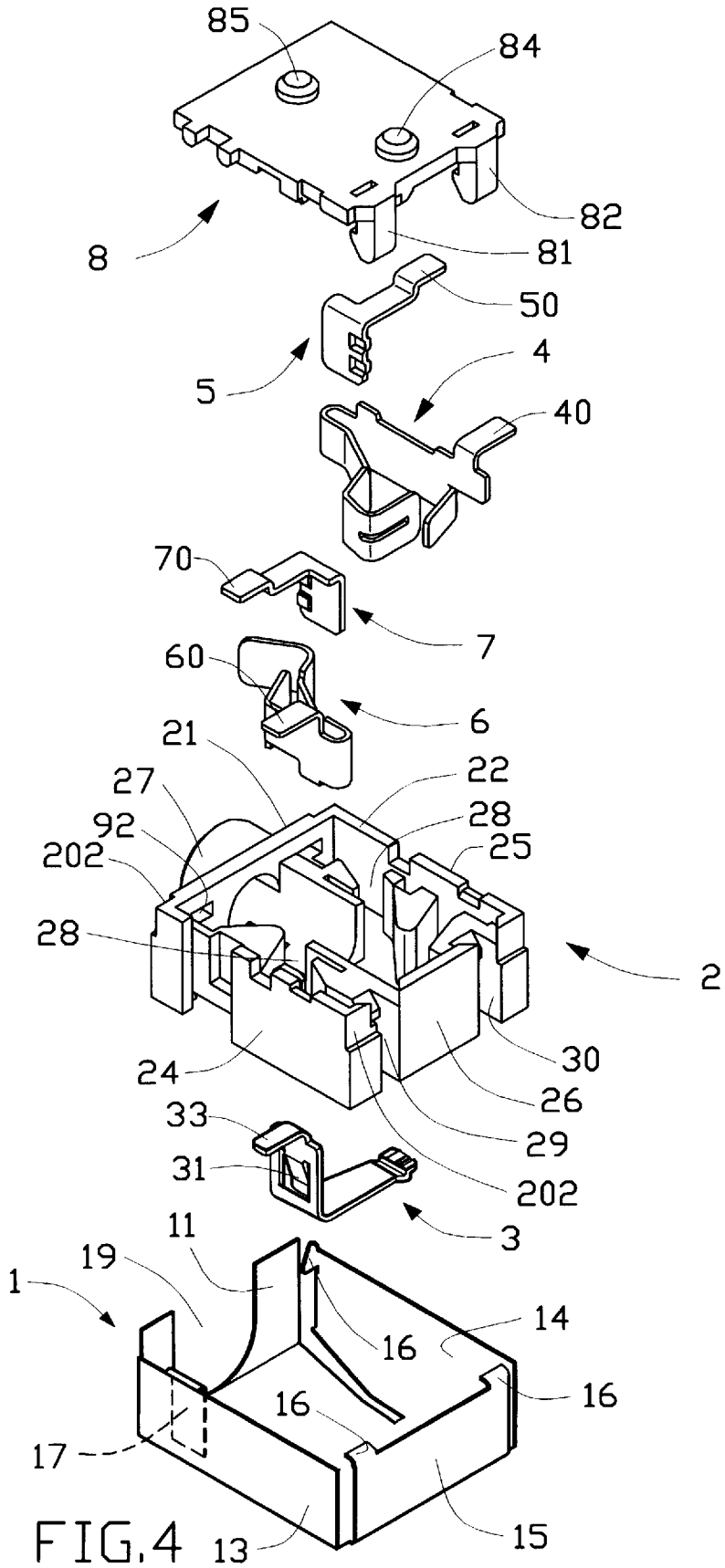
FIG. 4 is another exploded view of the electrical jack of the present invention.
Figure 5:
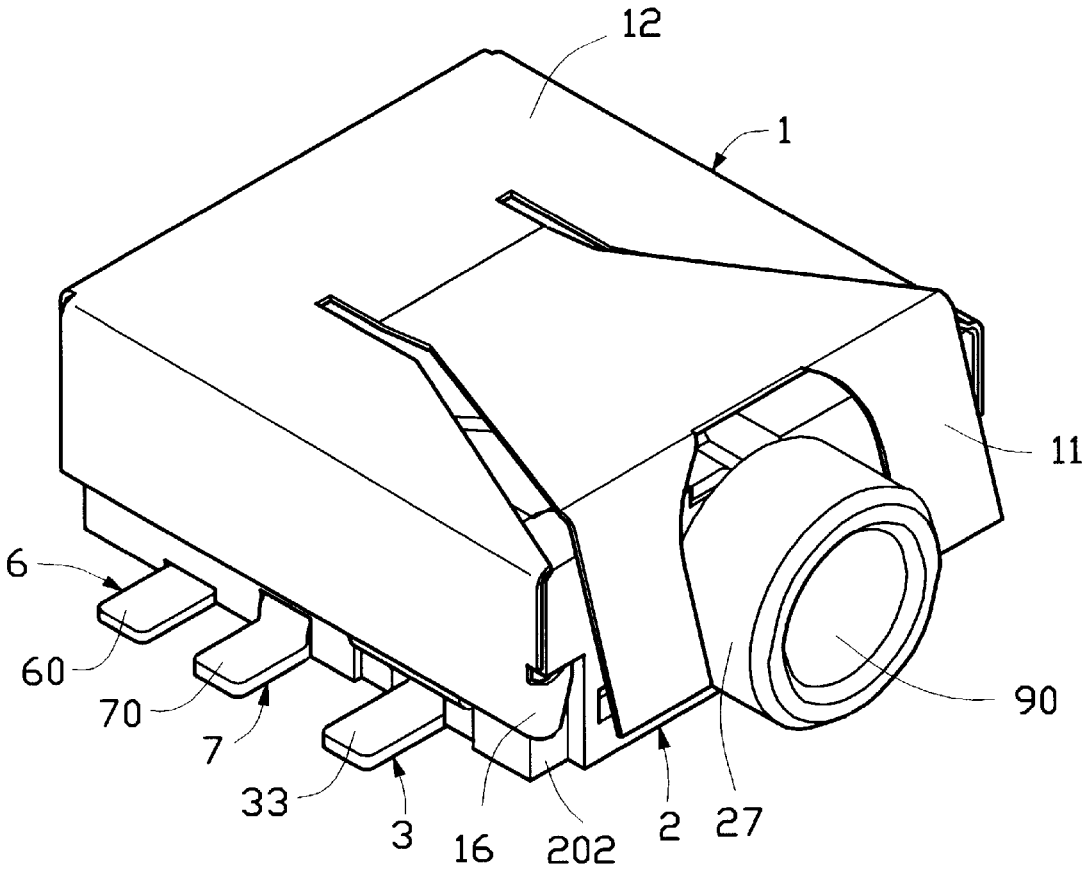
FIG. 5 is an assembled view of FIG. 3.
Figure 6:
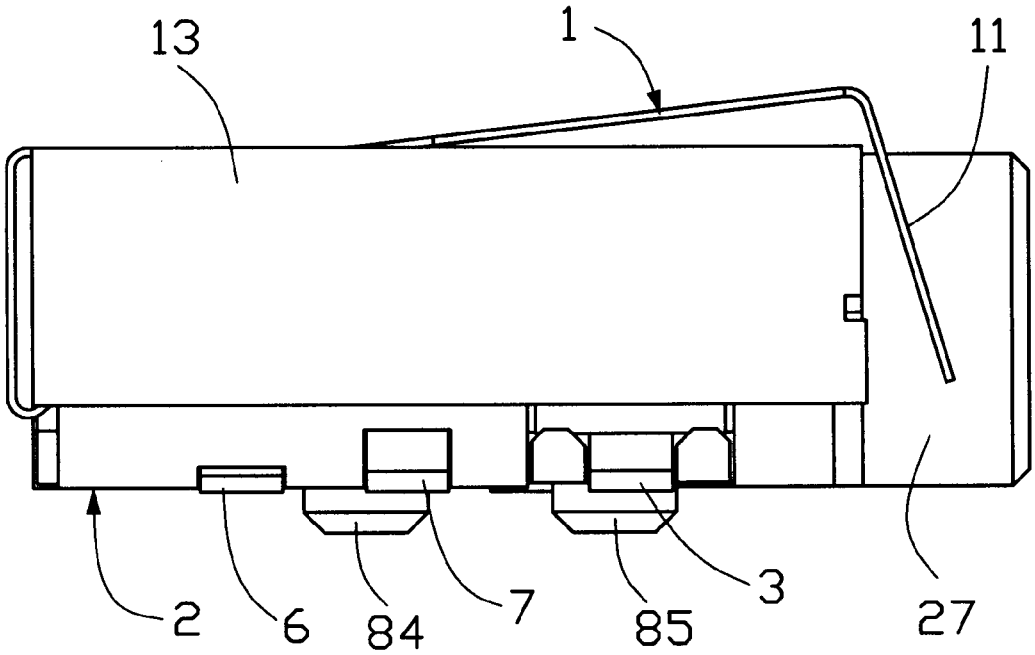
FIG. 6 is a side elevational view of FIG. 5.

Referring to the drawings and in particular to FIGS. 3 and 4, an electrical jack constructed in accordance with the present invention comprises a metal shielding casing 1 enclosing an insulative housing 2 defining contact receiving chambers 28 therein exposed to a bottom face 22 thereof, and a bottom cover 8 attached to the bottom face 22. Contact elements 4, 5, 6, 7 are received in the contact receiving chambers 28. As shown in FIGS. 5 and 6, the contact elements 4, 5, 6, 7 have end tabs 40, 50, 60, 70 extending beyond the housing 2 for being soldered to a circuit a board (not shown).

A cylindrical projection 27 extends from a front wall 21 of the insulative housing 2 and defines a plug receiving bore 90 therein for receiving a mating plug (not shown). The plug receiving bore 90 communicates with the contact receiving chambers 28 for allowing the plug to contact the contact elements 4, 5, 6,7.

The insulative housing 2 comprises a top wall 23, the front wall 21, a rear wall 26, a first side wall 24 and a second side wall 25. The shielding casing 1 has a top panel 12, a rear panel 15 and first and second side panels 13, 14 dimensioned to fit over the top wall 23, the rear wall 26 and the first and second side walls 24, 25 of the insulative housing 2, respectively. The rear panel 15 and side panels 13, 14 of the shielding casing 1 are provided with retaining tabs 16 engaging with corresponding recesses 202 defined in the insulative housing 2 for securing the shielding casing 1 to the insulative housing 2.

The shielding casing 1 forms a resilient flap 11 extending from the top panel 12 thereof and partially shielding the front wall 21 of the insulative housing 2. A cutout 19 is defined in the resilient flap 11 for partially receiving the cylindrical projection 27. The resilient flap 11 ensures proper electrical engagement with a grounding member of the mating plug to form a grounding path.

Two slots 29, 30 are defined in the rear wall 26 of the insulative housing 2 and two openings 92 are defined in the front wall 21 thereof. The bottom cover 8 forms two front projections 94 received in the openings 92 of the insulative housing 2 and two resilient rear legs 81, 82 received in the slots 29, 30 of the housing 2. Each rear leg 81, 82 has a barb 93 for engaging with a corresponding recess (not shown) formed in the rear wall 26 within the corresponding slot 29, 30 thereby securing the bottom cover 8 to the housing 2.

The bottom cover 8 is also provided with a pair of positioning posts 84, 85 for insertion in holes (not shown) defined in the circuit board for properly positioning the electrical jack thereon.

A slot 20 is defined in the first side wall 24 of the insulative housing 2 and communicates with a slot 20' defined in the top wall 23. A grounding member 3 has a first section 95 and a second section 96 respectively received in the slots 20, 20'. The grounding member 3 forms an inward projection 31 on the first section 95 for engaging with a recess 201 defined within the slot 20 thereby retaining the grounding member 3 on the insulative housing 2.

The grounding member 3 has an end tab 33 extending beyond the slot 20 for being soldered to the circuit board to provide electrical grounding. Preferably, the end tab 33 of the grounding member 3 and the end tabs 40, 50, 60, 70 of the contact elements 4, 5, 6, 7 are substantially flush with each other for facilitating surface mounting to the circuit board.

The shielding casing 1 is provided with an inward strip 17 extending from the first side panel 13 thereof. The inward strip 17 is resilient and is received in the slot 20 of the insulative housing 2 for engaging with the grounding member 3 thereby grounding the shielding casing 1. It should be noted that the shielding casing 1 is also grounded via the engagement between the resilient flap 11 and the grounding member of the mating plug. Therefore, a double-grounded configuration is formed.

Although the present invention has been described with reference to the preferred embodiment, it is apparent to those skilled in the art that a variety of modifications and changes may be made without departing from the scope of the present invention which is intended to be defined by the appended claims.

What is claimed is:

1. An electrical jack comprising;

an insulative housing defining chambers therein for receiving and retaining contact elements, the insulative housing having a mounting face adapted to be mounted to a circuit board and a mating face defining a bore communicating with the chambers and adapted to receive a mating plug extending into the chambers, the insulative housing defining a number of recesses therein;

a shielding casing enclosing the insulative housing, the shielding casing comprising a number of retaining tabs engaging with the recesses of the insulative housing, respectively, for securing the shielding casing to the insulative housing; and a grounding member attached to the housing and having an end tab extending beyond the housing for electrically engaging with a grounding path of the circuit board, the grounding member electrically engaging with the shielding casing thereby grounding the shielding casing; wherein the insulative housing has a side wall defining a first slot, a recess by defined within the first slot, the grounding member comprising a first section received in the first slot, an inward projection being formed on the first section for engaging with the recess thereby retaining the grounding member on the insulative housing; wherein the shielding casing comprises an inwardly extending strip received in the first slot and resiliently contacting the first section of the grounding member thereby forming an electrical engagement therebetween; wherein the insulative housing comprises a top wall defining a second slot communicating with the first slot, and wherein the grounding member comprises a second section extending from the first section and being received in the second slot; wherein the shielding casing comprises a resilient flap which is engaged by a grounding member of the mating, plug thereby grounding the shielding casing; wherein the resilient flap is deformed by the mating plug when the plug engages with the jack thereby ensuring proper contact therebetween; wherein the insulative housing comprises a front wall forming the mating face from which a cylinder projects, the bore being defined through the cylinder, and wherein the resilient flap defines a cutout for insertion of the cylinder therein; wherein the chambers of the housing are exposed to the mounting face thereof, a cover being attached to the mounting face; wherein the insulative housing defines openings in a front wall and slots in an opposite rear wall thereof, and wherein the cover forms projections received in the openings and resilient leg fib into the slots in the rear wall of the insulative housing, the resilient legs forming barbsfor engaging with recesses defined in the housing to secure the cover to the housing.

* * * * *